United States Patent [19]

Ward, Sr.

[11] Patent Number: 5,066,256

[45] Date of Patent: Nov. 19, 1991

[54] BUOY AND RELEASING SYSTEM FOR SHIPS IN DISTRESS

[76] Inventor: Robert B. Ward, Sr., Rte. #1, Box 175, Jane Lew, W. Va. 26378

[21] Appl. No.: 593,466

[22] Filed: Oct. 3, 1990

Related U.S. Application Data

[63] Continuation of Ser. No. 311,942, Feb. 17, 1989, abandoned.

[51] Int. Cl.[5] ..... B63B 22/08; B63B 22/18

[52] U.S. Cl. ..... 441/7; 114/328; 441/11; 441/16; 441/26; 441/27; 441/28

[58] Field of Search ..... 114/326, 328, 329; 441/6, 7, 8, 11, 13, 16–18, 23, 26, 27, 28, 29

[56] References Cited

U.S. PATENT DOCUMENTS

| | | | |
|---|---|---|---|
| 504,225 | 8/1893 | Larsson | 441/11 |
| 579,548 | 3/1987 | Pierce . | |
| 1,605,343 | 11/1926 | Gould . | |
| 2,083,306 | 6/1937 | Rooke . | |
| 2,323,064 | 6/1943 | Lustfield | 177/311 |
| 2,448,713 | 9/1948 | Hansell | 177/386 |
| 2,592,461 | 4/1952 | Perkins et al. | 441/17 |
| 3,276,007 | 9/1966 | White | 340/261 |
| 3,529,562 | 9/1970 | McLaren . | |
| 3,603,952 | 9/1971 | Smith | 340/224 |
| 3,618,150 | 11/1971 | Anselmi . | |
| 3,703,736 | 11/1972 | Higgs | 441/26 X |
| 4,040,135 | 8/1977 | Arnold | 294/66 R |
| 4,626,852 | 12/1986 | Dodge | 340/985 |
| 4,630,289 | 12/1986 | Wren | 441/11 |
| 4,759,735 | 7/1988 | Pagnol | 441/16 |

*Primary Examiner*—Sherman Basinger
*Attorney, Agent, or Firm*—John P. Halvonik

[57] ABSTRACT

An improved water flotation release device for locating the submerged position of ships that have sunk. The device comprises an improved release buoy that is self contained and communicating and a releasing system that leads to non-violent and reliable release from the sinking ship.

8 Claims, 10 Drawing Sheets

BUOY AND RELEASING SYSTEM FOR SHIPS IN DISTRESS

This is a continuation of Ser. No. 07/311,942 filed Feb. 17, 1989 and now abandoned.

STATEMENT OF THE INVENTION

The invention relates to a buoy and system for releasing the buoy when a ship is sinking. The improved system provides for a non-violent release and one with fewer moving parts that can harm the dependability of these devices. The anchoring system provides a non-tangling reel and line and minimizes downstream movement from the site of sinking.

BACKGROUND AND SUMMARY OF THE INVENTION

Releasing buoys are well-known in the art as a means for sending off locating signals for the position of a submerged ship and also to act as a locater buoy for recovery operations that take place on the surface. Some of the more recent inventions have involved the use of buoy-containing chambers that fill with water as the ship's bow (or whatever level the buoy chamber is located on) goes under the water. These inventions fill with water and the buoy is buoyed up and is set off for the surface of the water. A few are equipped with electrical signaling equipment.

Some of the problems in the art that this invention overcomes are presented in the following observations on prior patents. The Lustfield device U.S. Pat. No. 2,323,064 depends upon the pilot to release the device by pulling trip wire. The human factors which go into such a decision are numerous, which in turn might cause the operator to trip it a good ways from where the aircraft would go into the water, depending upon how it landed. There is a possible chance that the bearings and brackets could indent into the spherical shell which may prevent it from releasing. Also the many parts, spring wound motor for operating the generator etc. might to lead a crucial breakdown in the release system. If one or two items failed, the complete unit would fail.

Also, it does not show a swivel at the buoy eye, which prevents the buoy from rotating 360 degrees in a direction perpendicular to its ascent. This could lead to tangling of the cable at the time of release or thereafter. The light would just show in whatever direction the buoy eye would hold it in. They also say cable (#27) is attached to a sea anchor. A sea anchor is used to slow the rate of drift and to hold the (lifeboat, vessel), or object into the oncoming sea. It could drift a long ways in 12 to 24 hours.

The Anselmi U.S. Pat. No. 3,618,150 could fail if there's a sudden jerk when it was being deployed off the sunken vessel. This might cause the cord to loop and jam in the guide tube. Also the brake which is in the form of a bolt screwed (threaded) through arm and bearing against the reel has a Metal to metal contact which could bind. Although it is in the water the rubbing will cause friction and may bind up the reel, so the cord would not come out completely. In compartment 6 which the life raft is in, a cover with wing nuts the cover shows no hinges. If the seas were a little choppy, water would go through the opening and ground out the batteries. And there are no means to charge the batteries. A device of this type should at least have high tensile strength, nylon line or aircraft cable or larger cable for larger applications.

In the Arnold U.S. Pat. No. 4,040,135, a buoy designed in this manner would have an erratic ascent to the surface of the water. Also with a flat bottom and no swivel, it would be very unstable in a rough sea. Without a swivel at either end, the float or the base, with an erratic ascent the float (#3) could very well become entangled. There are also no means to charge the batteries.

Also there may not be enough air space to make the float (#3) (which also has a convex outline) underneath to be very buoyant. The line playing out of the float instead of the base, might cause some restrictions in it's movements to the surface.

In Smith, U.S. Pat. No. 3,603,952 the device is for the monitoring of oil spills, industrial waste, sewage etc., it stays anchored in a permanent position. It is not a device to be released from a sunken vessel, but it has some items that could be related to such. Solar panels, Radio, flashing Beacon. The Patent didn't show or mention a Rectifier Diode to prevent the batteries from discharging through the solar panels during the times of darkness.

The present invention (communicating buoy and releasing system) will float free, without tangling, and it will deploy non-violently and dependably. The non violent release is provided by a water borne releasing system that lifts the buoy off the ship and activates its system after it has cleared the ship. The system also has fewer places for failure. A non violent release leads to a dependable deployment.

Another object of the invention is to provide a locating buoy that will remain in a fixed position in the water near the submerged position of the ship. The reel with non-friction brake as well as the heavy duty cable keep it stationary in rough seas. The rotating swivel prevents entanglement as well as enabling rescuers to sight the buoy form all directions.

Another objects is to deploy a self contained buoy that can operate even if severed from the ship.

Another object is to provide a reel that provides a reliable release, that won't bind because of the non metal to metal contact.

Another object is to provide an electrical system that can be continuously charged while the buoy is not in use, that can not be shorted out by waves during storage and that will not be discharged inadvertently through the solar panels. Because the radio is always charged when the buoy is not in use the ship's current location can always be stored in the buoy's communicating system in the event of sinking.

Parts And Their Numbers

Figure 1:
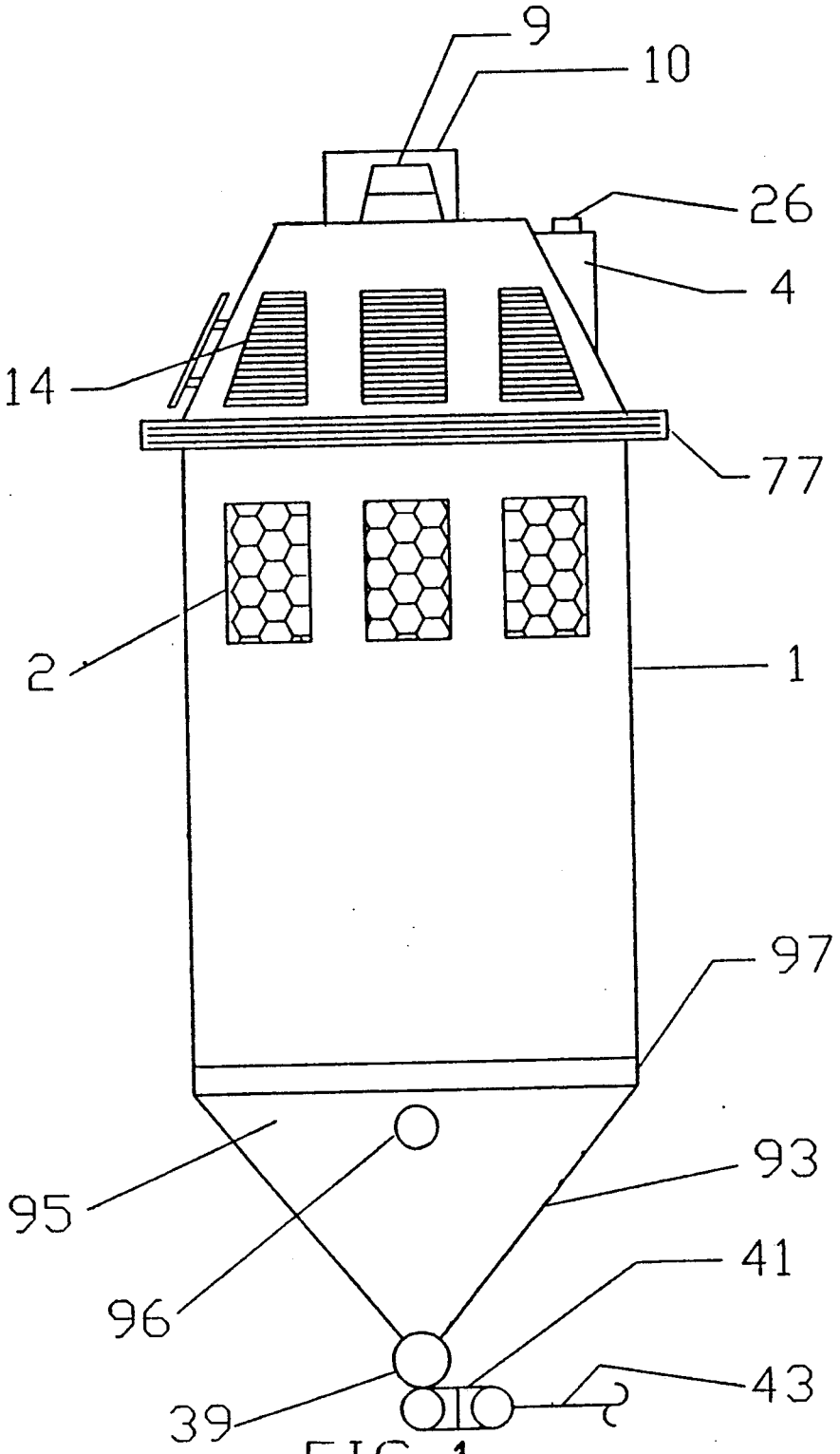
FIG. 1 shows the general use of the buoy

#1—communication buoy
#2—Reflectors
#3—cable reel
#5—Buoy guide rods
#6—Hole in Rubber Pad
#7—Rubber Pad for Band to rest on
#8—Cradle Well
#9—Hi intensity light
#10—Protective Cover
#11—Hi tech radio
#12—Bottom Plate of Cradle
#13—Storage position of solar panels
#14—Deployed solar panels
#15—Holes in bottom container box (for entrance of water)
#16—Container box
#17—container box fasting angle to deck
#18—Container Lid
#19—watertight sonar beeper box and batteries
#21—reel standards
#23—stainless washers (for each end of sealers)
#25—spacer between reel flange and reel bearing washers
#27—stainless steel reel shaft
#29—top of buoy guide
#31—stiffeners from container box to guide rod support band
#32—Support Band
#33—cable fasting device to reel flange
#35—Reel bearings to reel standards
#37—Heavy duty bearing support
#39—buoy eye
#41—marine type swivel
#43—cable from reel to buoy
#45—Reel standard fasting device to bottom of box
#47—deck of vessel
#49—gussets
#51—vents
#53—reinforcing gussets
#57—container lid handle
#59—spring loaded clips box to lid
#61—sonar beeper servicing door
#63—hinges to beeper service door
#65—service door lock
#67—flotation material underside lid
#69—spring loaded non friction brake
#74—steel guide ring
#75—brace for guide
#77—Protective band
#79—Service door
#81—Handle
#83—Free sliding shaft
#85—Tension Spring
#86—Reel Flange
#87—Non-friction pad
#89—Locknut
#90—Mounting Bracket
#91—Threaded Tension bolt
#93—Ballast
#95—Hollow cone
#96—Ballast filling hole
#97—Metal Plate
#99—male/female connections
#100—leads
#101—Testing Switch
#102—Mercury Switch
#103—Bridge Communications
#104—Rectifier Diode
#106—Sonar Beeper
#108—Radio Transmitter
#110—Charging test equipment

CONSTRUCTION OF THE BUOY AND CABLE RELEASE SYSTEM

The buoy 1, cradle well 8, and the reel 3 are contained in the container box 18. The box has a series of large and small holes 15 in it to permit the entry of water and the exit of air in the event of a sinking. These holes can be arranged in any manner that would permit the easy entry of water from a sinking ship while at the same time permitting the exit of air from the space inside the container. I have found that the best way is to have about two or three per side of the container and several more on the top of it, the holes along the side should be at different heights to permit the inlet of water and the exit of air. This arrangement allows the buoy to be floated up and out of the container very slowly. Tests done with the container in a small pond show that during the release it looks like the buoy is moving in "slow motion."

Figure 2:
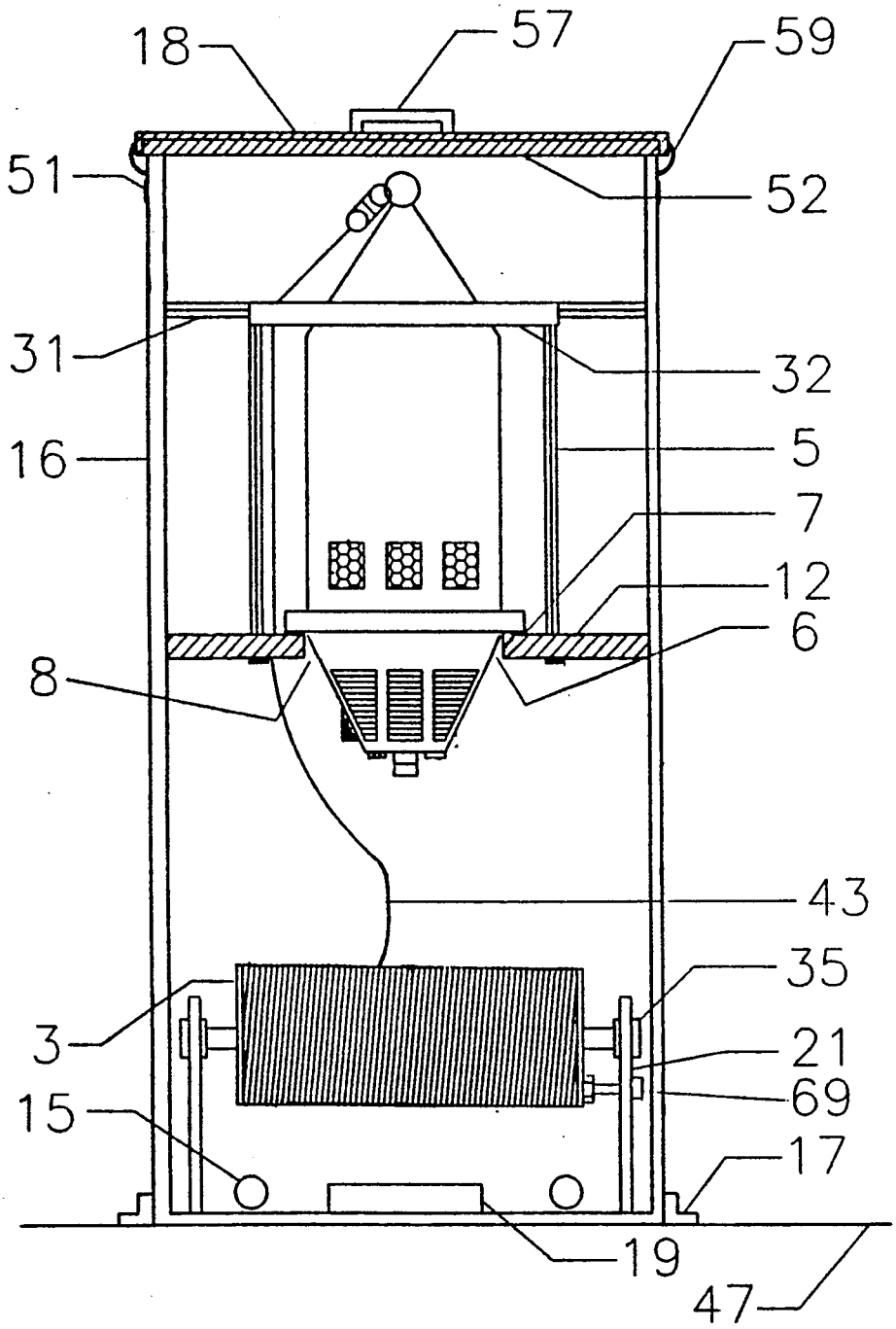
FIG. 2 shows the buoy and cable releasing system on board the ship in their storage position.

The cradle well is made up of the guide rods 5 (the number b1 use is 8 but can be more or less depending on the circumstances) arranged circumferential about the buoy. The guide rods can be attached in any manner that is sufficient to keep them stable for the release, I prefer to screw them into the bottom of the cradle 12, see FIG. 2. There is also a support band 32 that goes around the rods to stabilize them and stiffeners 31 that support the guide rods to the walls of the container. Near the end of the buoy chamber is a hard rubber pad 7 that the buoy rests upon in the storage phase (before the ship sinks). The pad is made of hard rubber to cushion and absorb vibrations that might otherwise harm the electrical component of the buoy. The pad could be built of other materials if it is not necessary to keep electrical equipment in the buoy or if circumstances dictate otherwise. The pad has its center cut out 6 to allow the light 9 and the solar panels 13 to protrude into when the buoy is in the rest position.

The buoy, of course, rests in the cradle in position upside down from the position it will assume after it is released and begins floating in the water. This puts the light 9 in downward position when the buoy is stored. When the container fills with water the buoy will float out through the guide rods and push open the container lid 18 on the top of the container. There is ballast in the buoy in the area indicated by 93 to cause the buoy to turn after it becomes buoyant and has cleared the guide rods 5. The ballast is filled through a reclosable hole shown at 96 into a hollow area 95 formed by a metal plate at one end and the tip at the other. I prefer to use a lid but any arrangement that will permit the buoy to escape from the box is sufficient. Preferably the lid is kept on with spring loaded clips 59, these can be made in any way that permits a force to be put on the lid but that will give when pressure from the buoy forces the lid off. Inside the buoy is a mercury switch 102 that will form an electrical connection after the buoy turns over 180 degrees, putting the light on top. The buoy makes this flip because of ballast 93 in the end of the buoy that has the swivel 41, see FIG. 2. Any system that permits the buoy to turn 180 degrees and thus activate a switch would be feasible but the arrangement shown here is the best to my knowledge.

Figure 8:
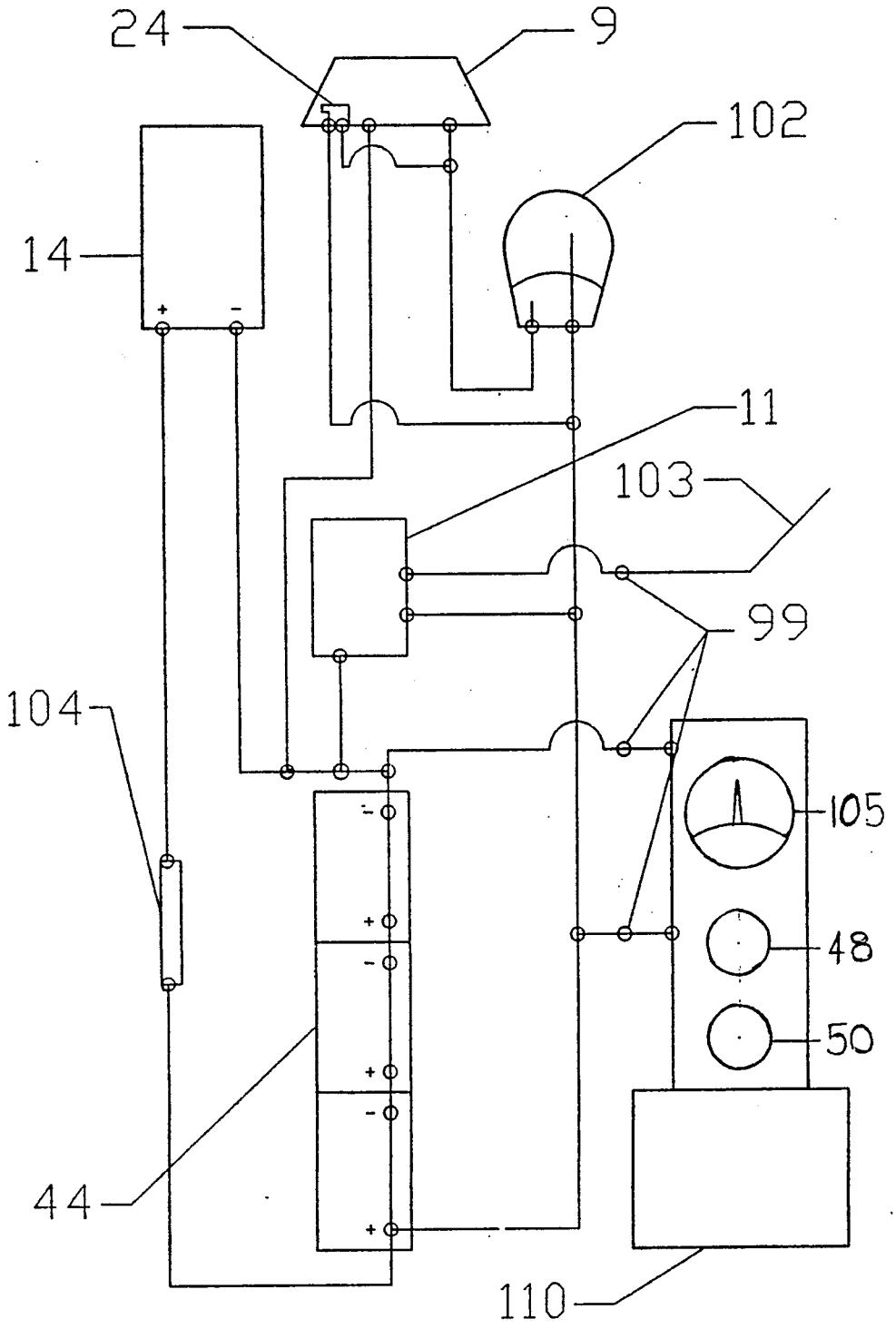
FIG. 8 Electrical System
Figure 9:
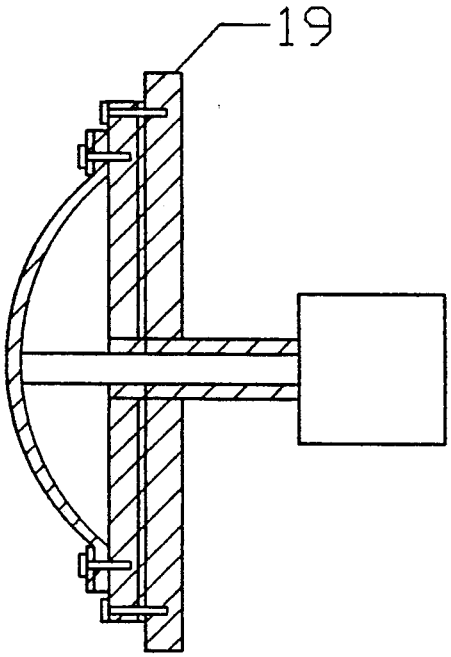
FIG. 9 is a top view of the container box
Figure 10:
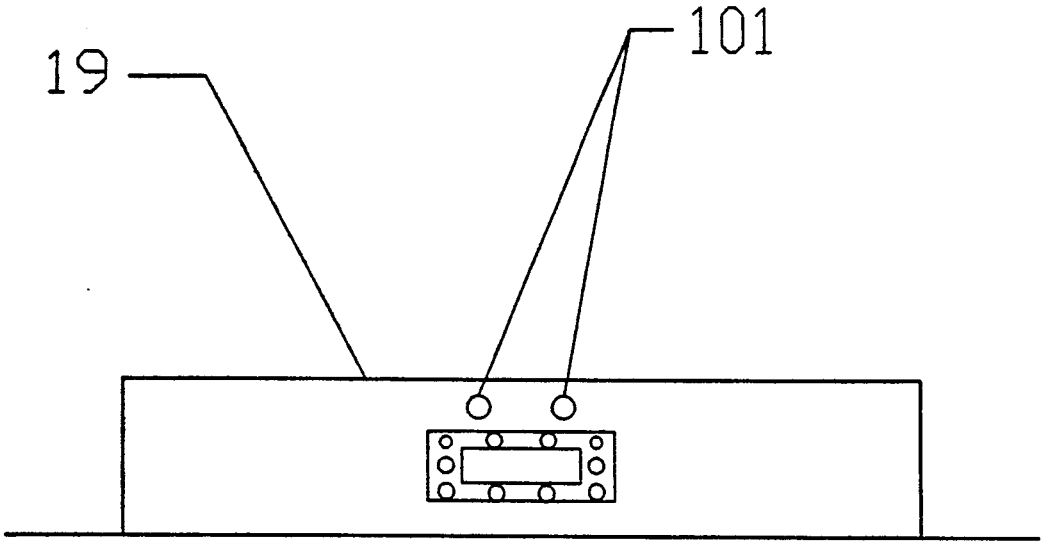
Figure 10:
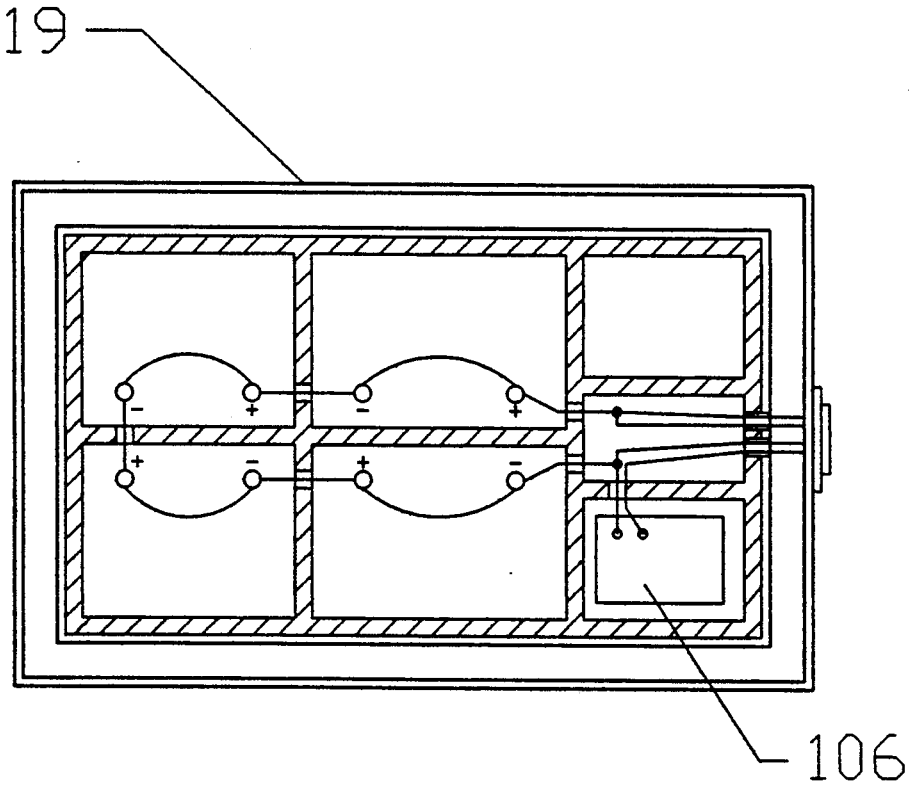

The test panel and charging system for the buoy batteries 110 is located on the outside of the container, and is connected to the batteries and internal electric equipment of the buoy by means of the male/female connections 99. The leads 100 to the connections would lead through an opening in the container. The testing equipment 101, the continuous charging system 110 and the sonar 106 would thus be left behind when the buoy leaves the container, a solar charging system within the buoy would go along with it. The testing system is equipped with a volt meter and test circuit, which is push button activated. When the test button is pushed you will get the current state of the batteries voltage on the volt meter, showing whether or not a battery or batteries are bad. The batteries are kept charged by an automatic charging device, which senses the battery or batteries state of charge, keeping batteries fully charged at all times. Incorporated into the system is a red panel light and audible beeper which activates if battery or batteries are defective, this is an extra measure of protection, in case a battery or batteries would go bad in between periodic checks. Charging and test system (male jack) are connected to the buoy through a container compartment flange or any other sufficient opening located on the container. The male jacks are connected to female jacks which are in turn connected to the buoy. The female jacks are enclosed in water tight boots which will seal when they are separated from the male counterparts when the buoy is released. Male jacks from charging and test system, will disengage from female jacks, at the time of deployment. The rubber boot will seal the female jacks when they are pulled from the male jacks by the release. Any system that permits the disengagement of the testing and sonar devices from the buoy is acceptable. This is one of many ways that the system can be wired (see FIG. 8). Other arrangements are possible if the sonar/charging is not needed. The vessels communicating system will also be connected through the jacks to the buoy radio. That is why it is imperative that the buoy radio is energized at all times. When the vessel is sinking and the distress button is pushed, the ship will communicate with a satellite communicator in the sky the will instantly send the ships position back to the sinking vessels communicating system and then automatically into the buoy's radio receiver so the buoy can then carry the position with it as it reaches the surface. Alternately the buoy's radio can be equipped with an electrical communicating system that communicates with the satellite by itself, the satellite will reply directly back to the buoy's radio, this would be as an extra precaution if the ship's system does not work for any reason. Of course some applications of the system may not require the communicating system, it is not necessary to the functioning of the buoy as a marking device.

While in the storage position the buoy is attached by cable 43 (or any other type of useful connector) to a reel 3 inside the container box. This is necessary for the buoy to float over the ship to mark its location, the reel can be either in or out of the container, I prefer it inside the container. There is a heavy marine type swivel 41 attached to Buoy Eye 43 which will let the Buoy rotate 360 degrees, which will let the solar panels 14 receive a high rate of solar energy, for charging the batteries and will permit the light 9 to rotate in all directions for rescuers. The swivel also aids in the prevention of tangling while the buoy is floating from the ship. The cable reel shaft 27 is mounted in non-friction sealed bearings 35 in reel standards 21. The non-friction brake 69 is mounted on a reel standard 21 (can be mounted on either standard) and is in frictional relation with the reel flange 86 until water enters the container. It is called non-friction because the brake does not heat up when in use because there is no metal to metal contact which would otherwise generate heat during the braking process. The brake consists of a non-friction pad 87 (the pad can be made of any material that is non-metallic, isoprene is preferred, this is to avoid the build up of heat which could otherwise bind the reel even while underwater) riveted to a steel back plate (on the edge in connection with the spring) which is welded to a free sliding shaft 83, preferably these are made of steel but not limited to it. The free sliding shaft fits inside the threaded shaft 91 which is threaded through a mounting bracket 90 which is bolted to the reel standard. There is a spring 85 that keeps tension on the reel until the container fills with water, this is necessary to prevent the inadvertant unwinding of the reel which could otherwise cause entanglement problems when the buoy is released. When the container fills with water, friction between the brake and the flange 86 is reduced and the reel will unwind freely when the buoy floats up, the weight of the cable prevents further winding after the buoy reaches the surface. Threaded shaft has a hex type head to adjust tension and a locknut 89 (locknut is drill tapped for an allenhead set screw). Tension is adjusted by screwing in tension bolt 91 against tension spring causing desired pressure of the non-friction brake pad against the reel flange surface 86. Locknut is then tightened up against mounting bracket face, set screw in locknut is then tightened, securing brake. This breaking system inhibits the reel from paying out into the compartment box which could cause entanglement, yet once the buoy starts deployment the reel will payout cable freely, as water acts as a lubricant. Any suitable arrangement that accomplishes this is sufficient, my arrangement is preferred. Another arrangement is referred to as "piggy back" style, this refers to the arrangement where the reel is directly below the buoy when the buoy is in the fixed position. This arrangement may assist in the gentle release of the buoy.

Buoy cable is secured to reel flange with cable 43 going through a hole in flange near shaft 33. Four holes drilled and spaced properly for u-clamps, installed from inside of flange to outside of flange to hold the cable securely to the reel. Cable runs outside of flange through the two u-bolts, cable clamps, and nuts, are installed on the u-bolts and tightened securely. Any sufficient measure that secures the cable to the reel is suitable. Any suitable material can be used to connect the reel to the buoy, I prefer heavier cable because that keeps the buoy steady and prevents its drift, the heavier cable keeps the non-friction reel from giving slack during the buoy's floating period.

Upon deployment cable feeds through a ring 74 made of stainless steel, titanium, etc., which is mounted to the buoy box with braces 75 each brace mounted to the center of each container box wall. Each brace is reinforced with bracing to the cradle plate. Friction between cable and ring will be kept to a minimum, due to the water acting as a lubricant. Alternatively, rollers can be used to replace the ring. These would be above the reel and will help the cable pay out and keep slack to a minimum.

Our system is far superior, due to simplicity in design, state of the art electronics, buoy deployment, cable feed, ease of maintenance, rugged design. We believe manufacturing costs will be kept to a minimum because of simple construction and minimum parts.

Figure 3:
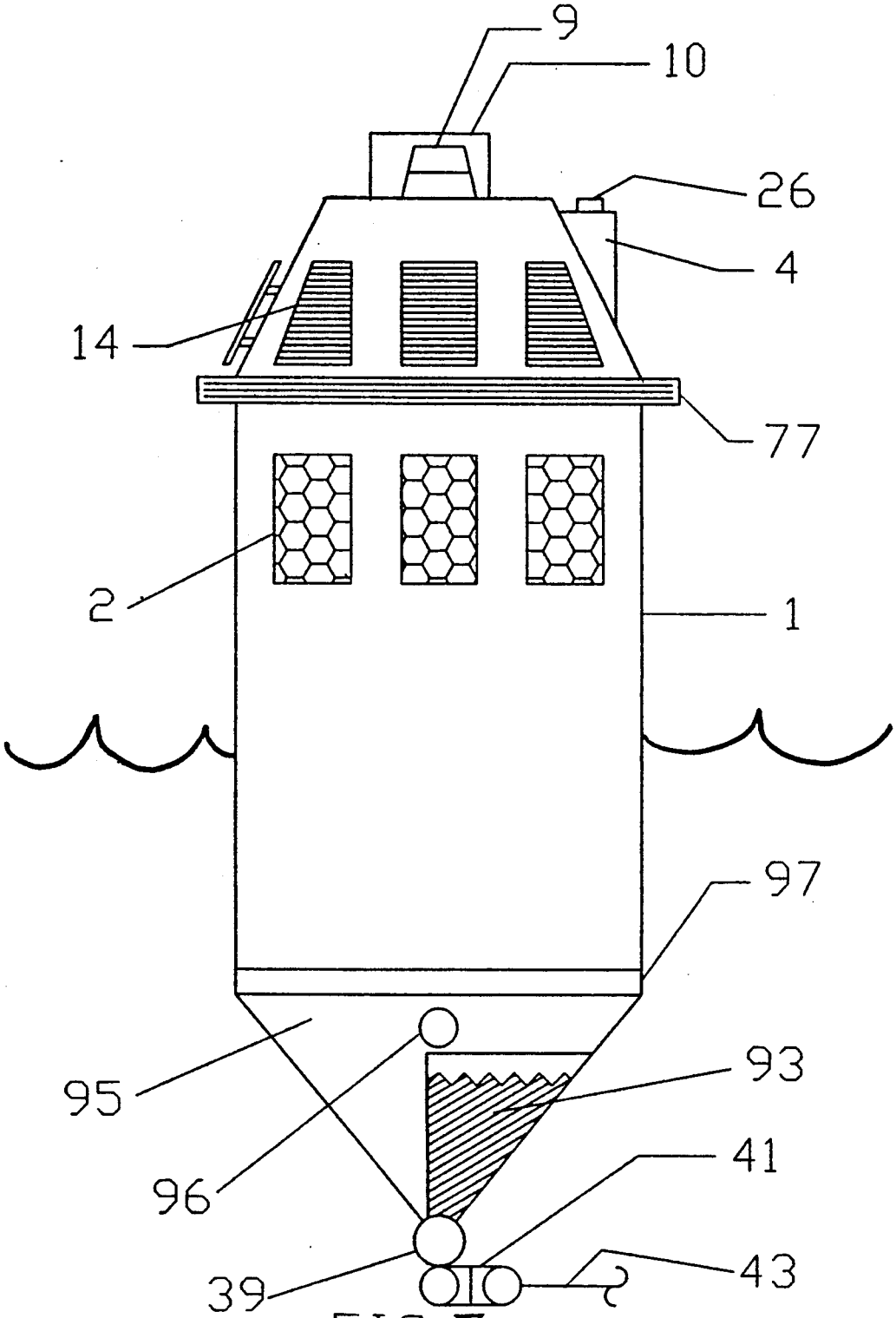
FIG. 3 shows the buoy's construction when it is in the floating position.
Figure 4:
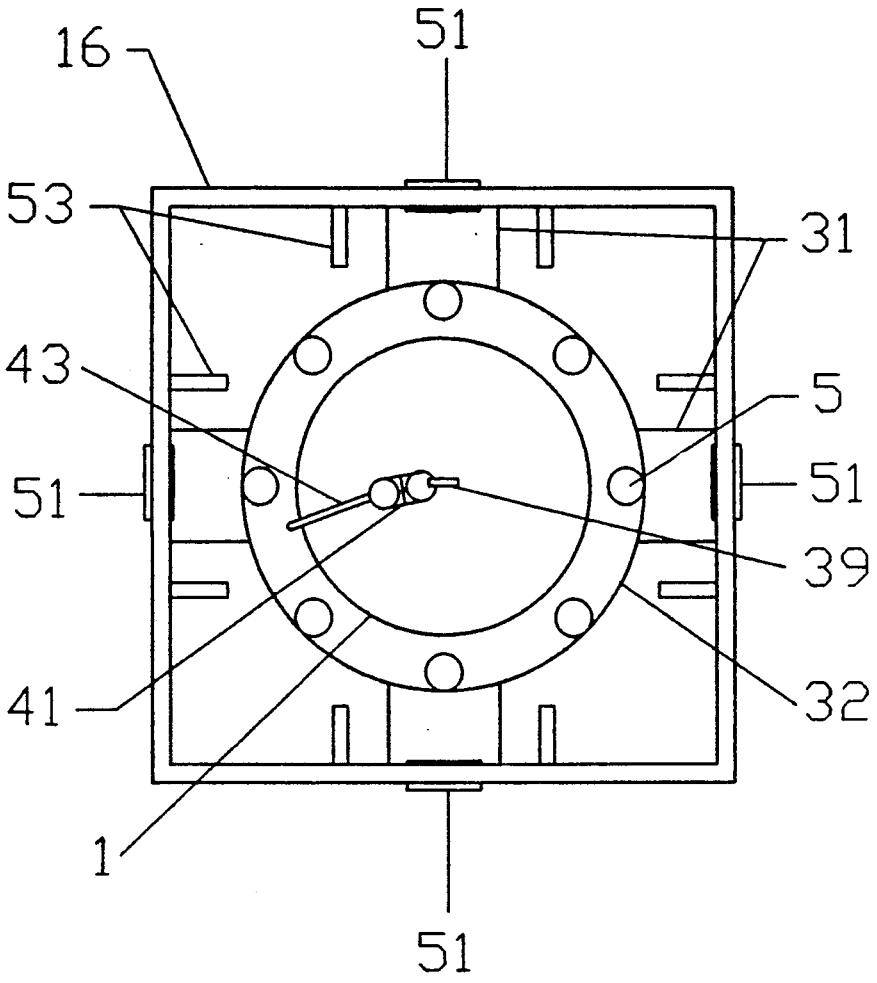
FIG. 4 is a top view of the buoy and release system in the storage position.
Figure 5:
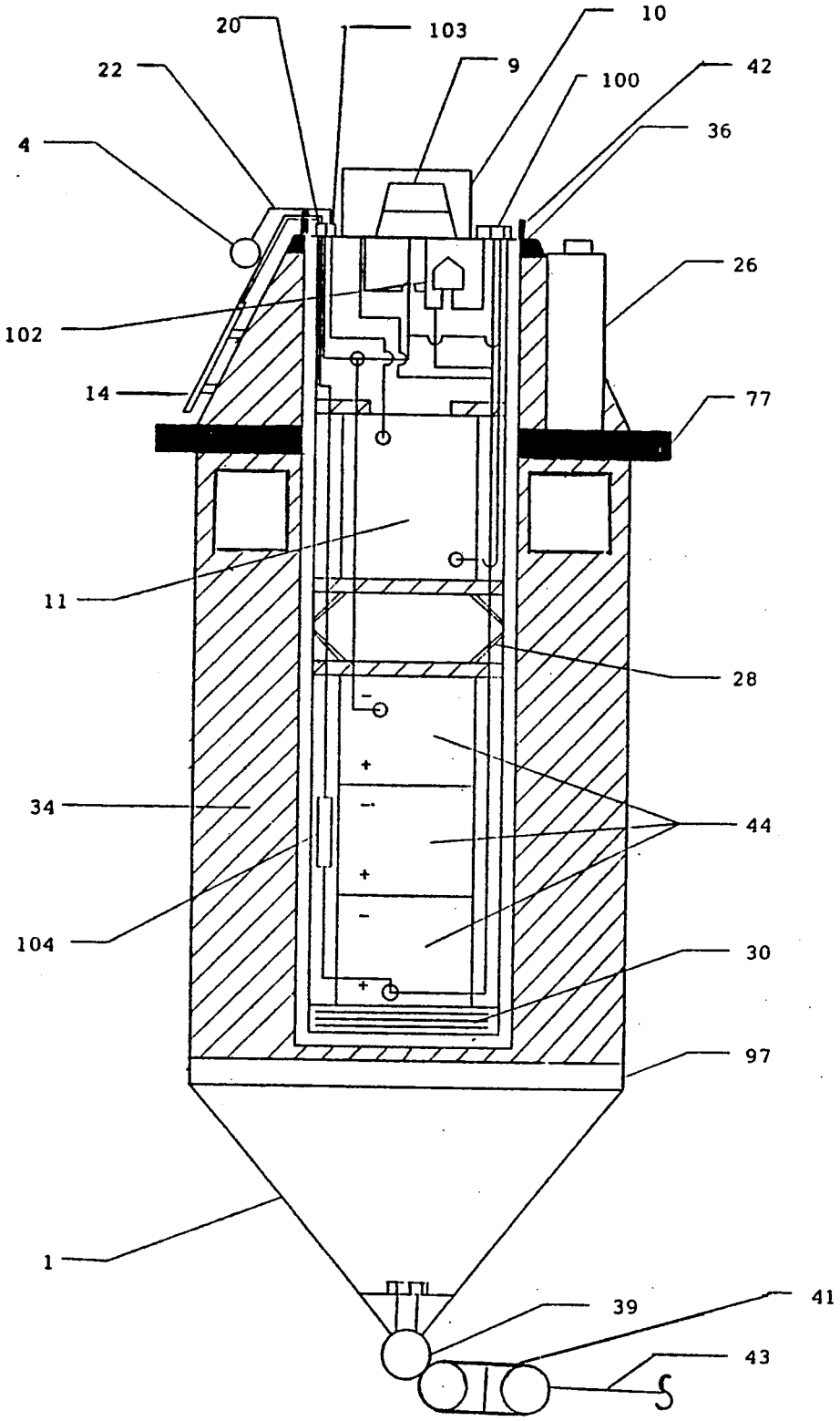
FIG. 5 is a side view of the reel itself
Figure 6:
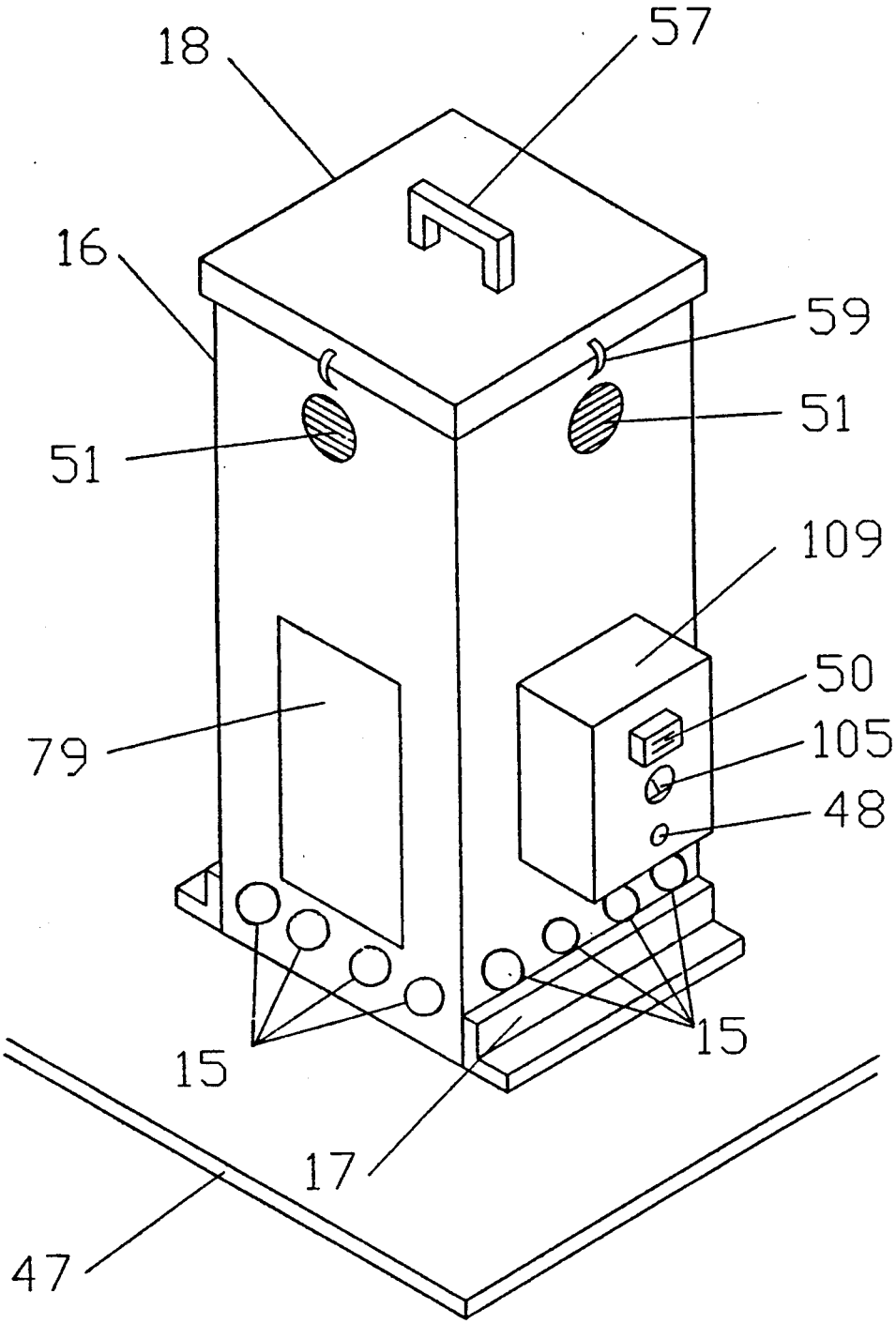
FIG. 6 is an outside view of the box that contains the releasing system.
Figure 7:
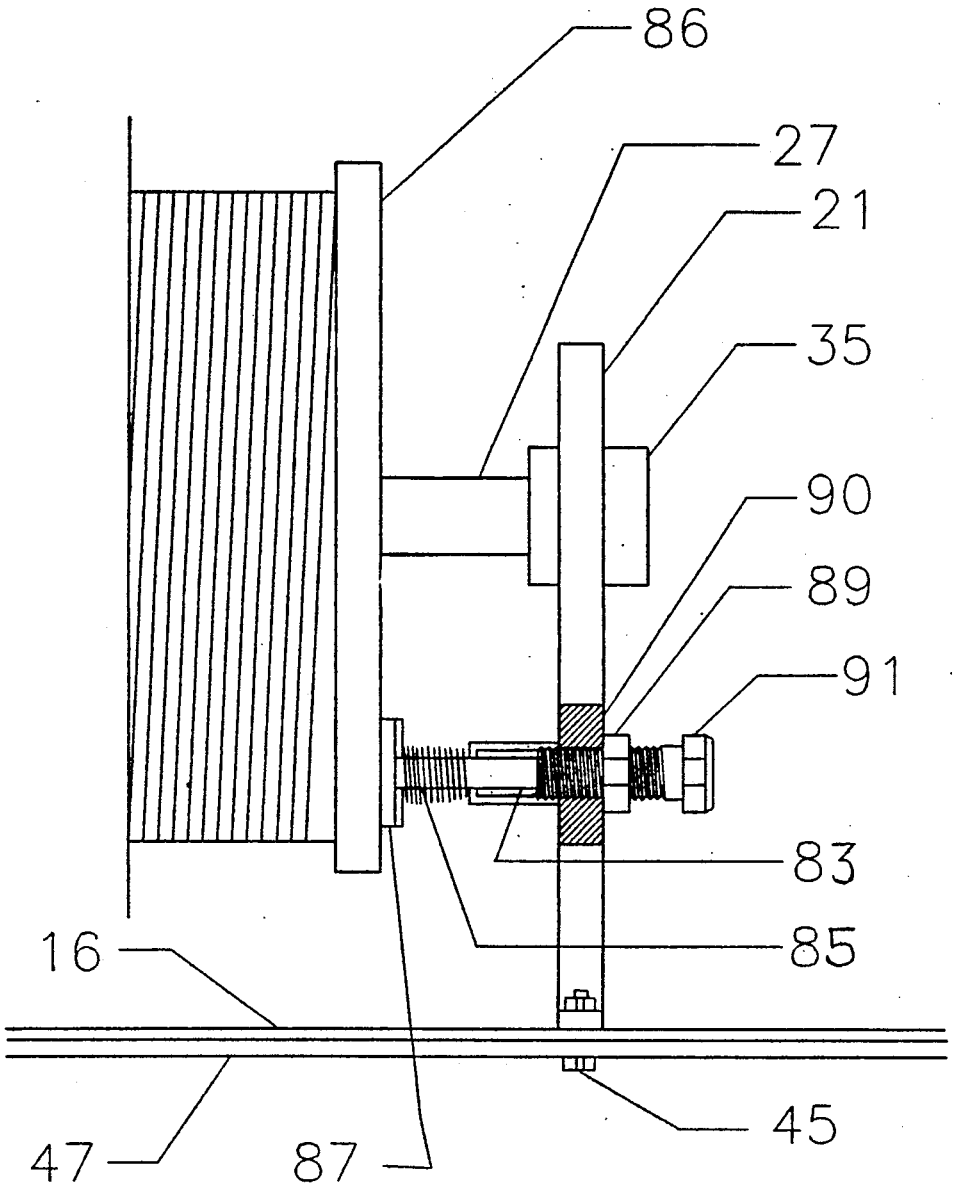
FIG. 7 is a view of the reel that shows the non-friction brake.

Note; measurements, sizes, etc. will vary with various applications. The buoy section around the electrical components should be compartmentalized to prevent crushing from the pressure of water at great depths. The solar panels can be mounted in various arrangements to maximize their solar gathering ability. Preferably the panels will be spring loaded in the buoy cradle, their initial position 13 over the light 9 see FIG. 2. After the buoy clears the container they will fold down from the force of the springs and assume the position 14 in FIG. 3. Other arrangements for the panels are possible, for instance they can be parallel to the surface of the water to increase their gathering potential. The important point about the solar panels is that they keep the buoy's radio and electrical system fully charged and operational. Any arrangement that permits this would be acceptable. To minimize the power drain the circuit could be equipped with a photo sensor that responds to light that could turn off the light in the daytime and turn it on at night and so conserve energy, any arrangement known in the art would do. The rectifier 104 is built into the system to prevent the solar panels from discharging electricity during the nighttime, any known arrangement could be used. Metal can be placed in position below the band 32 to increase the ability to be picked up by radar. A radio should also be mounted on the buoy in whatever position necessary either encircled around the buoy or projecting up from it. Screens should be placed over the holes 15 to prevent the entry of debris.

This device can be constructed of various materials such as high impact plastics, aluminum, steel, etc., depending on the application. The buoy should be watertight.

If the unit is welded in place, as extra precaution the reel standards will be bolted through the container bottom 45 and through the deck of the vessel 17 and be secured by whatever measures necessary to keep it secure. Mounting location should be high on the superstructure with no overhead obstacles to hinder deployment.

The buoy beacon (light) 9 may have a screw on self sealing lens cover 10 that can be changed from red (hazardous) cargo, to white (clear) nonhazardous. Located under the lens is a test button which when pushed will show that the light is in working order. Note; the box containing sonar components may be compartmentalized for structural strength. This will keep water pressure which is crushing at great depth, from damaging the box.

I believe by device nearly impossible to become entangled. It is simple in design, and very easy to service and maintain. With six holes in bottom of Container box, as water comes in through the holes, the Buoy will Raise the lid will float off. As the lid has Flotation material underside, the Buoy will come out of the container, rotate 180 degrees, the mercury switch will activate the Hi-intensity light and hi-tech radio, thus the buoy will have a non-violent release. Also the spring loaded non-friction brake will help control the ascent. It is also used to steady the Reel in rough weather. Also, just in case that the cable should become severed, the Radio would continue sending the ships sunken position as it is self contained and can get the satellite signal under its own power. Also there is a sonar beeper and battery pack contained in the ship, it will be activated by a pressure switch, vessels coming to the disaster scene could pick up on sonar beeper and help in locating the sunken vessel.

Near the top of the container there should be styrofoam, or other flotation material to assist in the release of the buoy, preferably the floatation material is glued to the underside of the lid to prevent it from inhibiting the release. The light could be Red for hazardous cargo, and white for non-hazardous cargo, there is also a manifest or cargo ID Type mounted into the top of the buoy opposite to the side that the antenna is mounted. There will be reflectors on buoy and the buoy should be painted fluorescent orange or any other color that would facilitate rescue efforts. Also there are air vents in the top of the container box for good air circulation.

The device should be mounted high, like on the deck that the smoke stack is on, so it is out of the way of any overhead obstructions. It can also be mounted on the deck or below if that is necessary. It can be mounted in any type of container, round, square, etc. Alternatively the cable could be stored around a center post with end of cable fastened with a heavy duty marine shackle to a pad eye that is welded to the deck rollers could be used in place of the eye for cable to pay out through. They should be mounted between cable reel and buoy. The amount of cable to be used and size would depend on the application, oceans, bays, lakes, etc. where application would be for small vessels and pleasure boats, aircraft cable or even possibly nylon line could be used.

OPERATION OF THE RELEASING SYSTEM

Once the water level reaches over the ship's bow the container 16 will fill with water through the holes near the bottom of the container box 15. Air will exit out the upper holes. Other flotation material 67 (besides the buoy) can also be glued to the underside of the container lid, this will aid in opening the lid 18. The floating buoy will push open the lid that is held closed by spring loaded clips 59. The buoy will float up out of the cradle 7 that it rest in and the guide rods that surround Buoy will guide the Buoy free of the container box. It will rotate 180 degrees because of the placement of the ballast 93 and the weight of the cable 43. This will cause a mercury bulb switch #102 (which is stored in the off position) to activate the circuit from batteries to light, and activate the radio, transmitter and receiver. Of course the male jacks (a part of 99) for charging and communicating, will disengage as the buoy rises up through the guide rods. As the buoy breaks the surface of the water, light and radio, will already be operating. As the Buoy is ascending to the surface, the solar panels will deploy and lock in place to charge the Batteries, the Radio will start transmitting the sunken vessel's position. If in sunlight the solar panels 14 will start gathering energy and charging the batteries. And if it is dark, the rectifier diode 104 will prevent the batteries from discharging through the solar panels. A plexiglass cone could be fitted over the solar panels and fastened in place as a precaution against possible damage 10.

As the vessel sinks below the surface, the sonar beeper 106 will be activated by hydrostatic pressure against a plunger type switch that is sealed by a heavy neoprene diaphragm that will cover the plunger. Water pressure shoving against the diaphragm will shove the plunger in and close the circuit to the sonar beeper which will start sending out sound waves. Just in case the ship goes down so fast that the distress button is not pushed, after the buoy reaches the surface, a pre-programmed solid state chip in the radio transmitter 108 will transmit to the satellite communicator on board the ship, which in turn will immediately transmit the sunken vessels position to buoy, then the buoy will start transmitting the sunken vessels position. Of course the high intensity light 9 will be flashing red for hazardous cargo, and white for non-hazardous cargo.

Also just in case that the buoy cable should become severed the buoy is self contained, so it would be communicating the vessels sunken position. Also the sonar beeper 106 would be sending out sound waves and vessels approaching the sunken vessels position with sonar operative, could hover right over the sunken vessel.

I claim:

1. A buoy marker and a releasing apparatus for said marker for use on craft that may become submerged comprising:

a) Buoy means having top and bottom and signalling means located at the top of said buoy, said buoy being bottom heavy, said signalling means being in connection with a mercury switch capable of activating said signalling means, said mercury switch capable of becoming operational when said buoy is in an upright position, protective band located around the outer diameter of said buoy and close to the top of said buoy, said band having larger diameter than said buoy;

b) buoy releasing system comprising: resting plate comprising a resilient material with an aperture in the center, said aperture of larger diameter than said buoy and smaller diameter than said protective band so that said top of buoy is capable of protruding through said aperture and said protective band is capable of supporting said buoy upon said resting plate, a plurality of guide rods attached to said plate and arranged in a circular orientation to form a storage space, said storage space having bottom opening around said aperture and top opening above, so that said buoy is capable of resting within said storage space and moving out of said space through said top opening when said craft becomes submerged, frictionless reel means attached to said buoy by a cable.

2. The apparatus of claim 1 having an electrical system capable of supplying electrical energy to said buoy, said system capable of becoming operational upon the inversion of said buoy.

3. The apparatus of claim 2 where said cable is attached to a swiveling means in connection with said buoy.

4. The apparatus of claim 3 where said electrical system of said buoy is releasable connected to an electrical charging and testing system located aboard said craft.

5. The apparatus of claim 4 where said electrical system is capable of becoming operational when said buoy is in an upright position.

6. The apparatus of claim 5 where said signaling system comprises a lighting device.

7. The apparatus of claim 6 where said electrical system uses solar panels attached to said buoy.

8. The apparatus of claim 7 where said electrical system is capable of relating the position of said craft by radio communications.

* * * * *